US005341858A

United States Patent [19]

Albert

[11] Patent Number: 5,341,858

[45] Date of Patent: Aug. 30, 1994

[54] APPARATUS AND PROCESS FOR TRANSFERRING PRODUCTS

[75] Inventor: Lars G. A. Wadell, Aengelholm, Sweden.

[73] Assignee: Nestec S.A., Vevey, Sweden

[21] Appl. No.: 32,625

[22] Filed: Mar. 17, 1993

[30] Foreign Application Priority Data

Apr. 6, 1992 [EP] European Pat. Off. ..... 92105898.8

[51] Int. Cl.[5] ..... B65B 43/42; B67C 3/00

[52] U.S. Cl. ..... 141/173; 141/106; 141/241

[58] Field of Search ..... 141/168, 173, 174, 106, 141/237, 238, 241, 364, 1, 250, 270, 284, 156, 163, 171, 113; 198/703

[56] References Cited

U.S. PATENT DOCUMENTS 2,444,155 6/1948 De Back ..... 141/171

2,506,779 5/1950 Criger ..... 198/703

2,721,017 10/1955 Hiscock ..... 141/163

*Primary Examiner*—Ernest G. Cusick

*Assistant Examiner*—Steven O. Douglas

*Attorney, Agent, or Firm*—Vogt & O'Donnell

[57] ABSTRACT

Articles are transferred by an apparatus having a hollowed frame lacking a continuous peripheral wall in which a guide is positioned for slidably containing an open-topped bowl. A hopper connected with a holding plate is positioned within the frame to reciprocate to be fixed to a bowl contained in the guide so that upon rotation of the frame which, in turn, rotates the hopper and holding plate and the guide containing a bowl having a product therein, the bowl in the guide is moved from an upright position to an inverted position. During the rotation, the hopper is covered to contain product and then, upon bowl inversion, the product is released.

16 Claims, 4 Drawing Sheets

APPARATUS AND PROCESS FOR TRANSFERRING PRODUCTS

BACKGROUND OF THE INVENTION

The present invention relates to a filling system, especially for transferring products from filling/weighing machines to packaging machines.

There are several situations where it is not possible to place a filling/weighing machine directly over a packaging machine, examples of which are as follows:

1. when there is not space enough to place the filling-/weighing machine over the packaging system.

2. when more than one product should be filled, more than one filling/weighing machine has to be used, and this uses up valuable space.

3. when a product must be handled and weighed manually, such an operation being very tedious and causing many back and neck problems to the personnel owing to the repetitive turning and leaning movements required.

In such circumstances, many factories use bowls or cups as a link between the filling/weighing machines and the packaging machines.

SUMMARY OF THE INVENTION

The present invention provides a system for transferring products from filling/weighing machines to packaging machines.

According to the present invention, there is provided an apparatus for transferring products comprising:

a frame lacking a continuous peripheral wall adapted to rotate about a substantially horizontal axis, a guide within the frame, orthogonal to and extending between the sides of the frame and adapted to rotate with the frame, means for introducing an upright open-topped bowl containing a product through one side of the frame to contact the guide when positioned horizontally, means for rotating the frame to invert the bowl, means for covering and uncovering the top of the bowl first to fix and then subsequently release the bowl to and from the guide, for containing product during rotation of the frame and guide to invert the bowl and for enabling the product to be emptied out of the inverted bowl through the periphery of the frame, and means for removing the empty bowl away from a side of the frame.

The frame may have a form of a drum and may comprise a pair of gable rings held together by one or more transverse bars.

The present invention also provides a process for transferring a product which comprises introducing an upright open-topped bowl containing a product into one side of a hollow frame lacking a continuous peripheral wall adapted to rotate about a substantially horizontal axis to engage a guide within the frame which extends between and orthogonal to the sides of the frame and which is adapted to rotate with the frame, covering the top of the bowl and fixing the bowl to the guide, rotating the frame to invert the bowl, emptying the product through the periphery of the frame, rotating the frame to return the empty bowl to the upright position, releasing the empty bowl from the guide and removing the empty bowl out of a side of the frame.

DESCRIPTION OF PREFERRED EMBODIMENTS

Preferably, the frame is adapted to rotate intermittently so that it is stationary when a bowl is in an upright or an inverted position.

Advantageously, means may be provided for introducing a plurality of upright open-topped bowls into the upper part of one side of the frame either consecutively or side-by-side, and an appropriate number of guides are provided so that the bowls are inverted and emptied simultaneously and returned to the upright position together.

Conveniently, the means for introducing and withdrawing the upright bowls into and out of the sides of the frame is provided by a pair of horizontal conveyor belts, one at each side of the frame.

The guide may suitably be a guide rail provided with a base and side walls. If desired, more than one guide may be positioned within the frame, orthogonal to and extending between the sides of the frame, angularly displaced from one another and adapted to rotate with the frame so that each guide successively reaches a horizontal position in the frame where it can receive further individual bowls or groups of bowls containing a product.

The means for covering and uncovering the top of a bowl first to fix a bowl to a guide, as well as to enable the product to be emptied out of the inverted bowl through the periphery of the frame, may be provided suitably by a hopper fixed to and extending from a holding plate which is adapted to descend to fix the bowl to the guide and is provided with one or more openings to allow the product to flow out of the bowl when desired, and the hopper extends to the periphery of the frame and whose peripheral end is provided with opening and closing means, e.g., a slidable cover.

Containers of the packaging machine may be transported on a conveyor belt beneath the frame either parallel or transversely to the longitudinal axis of the frame.

Conveniently, the bowls are introduced into and withdrawn from the frame at opposite sides respectively. The bowls are conveniently pushed along the guide by succeeding bowls which have been introduced.

Products that may be handled include rice, meat chunks, diced meat, sliced meat, shrimps, potatoes, sausages, meat balls, vegetables and vegetable mix.

The present invention is described further by way of example only with reference to the accompanying drawings.

DETAILED DESCRIPTION OF THE DRAWINGS

Figure 1:
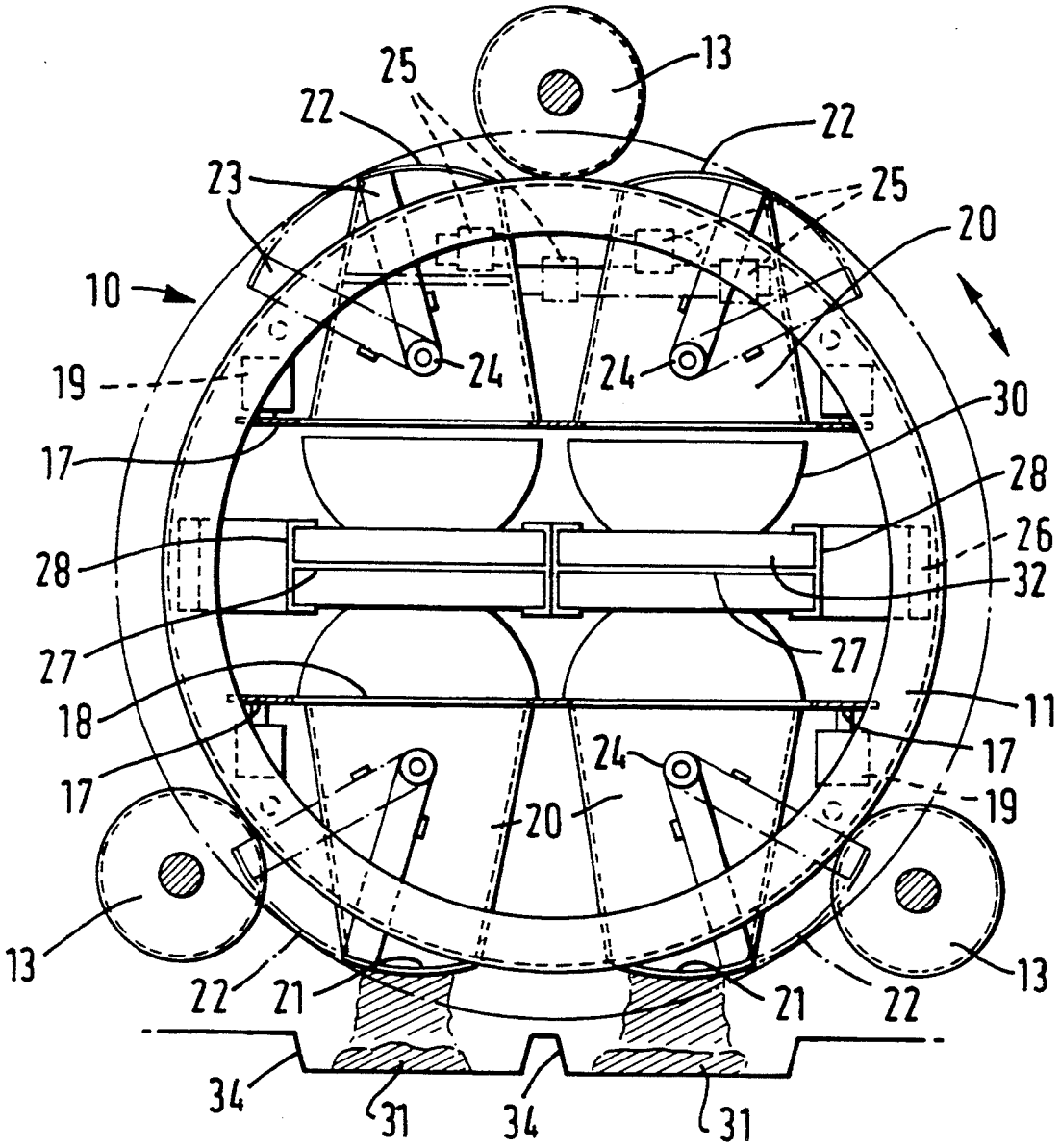
FIG. 1 represents a transverse section through the filling system.

Referring to the drawings, the filling system comprises a frame 10 having spaced apart first and second side members 11, such as gable rings, held together by longitudinally extending transverse bars 12. As illustrated, rings 11 are driven by drive wheels 13. Each of the ring members encompasses an opening about a central axis of each side member ring 11. Thus, bars 12 extend between and connect the side members so that the first and second side members form first and second frame sides which have an opening disposed about the central axis of each side member and so that the connecting member bars 12 are disposed between the side members so that the frame has an interior hollowed about a frame central axis coincident with the central axis of each side member and so that the frame has openings between connecting member bars. The drive wheels 13 provide means for rotating the frame so that the frame is rotated about the frame central axis disposed horizontally.

Square holding plates 17, each provided with four pneumatic mini-cylinders 19 capable of raising and lowering the holding plates, are fixed to the side member gable rings 11. Fixed to each holding plate 17 and aligned with the apertures 18 are four hoppers 20 which extend longitudinally between opposing first and second open hopper ends. Each hopper is provided with an aperture 21 and a slidable cover 22 operated by sliding plate arms 23, pivoted at pivot point 24, activated by pneumatic cylinders 25.

Fixed to the side member gable rings 11 by means of bolts 26 are guide rails 27 provided with side walls 28. The guide rails extend longitudinally within the interior hollow of the frame from side to side parallel to the frame central axis.

Figure 2:
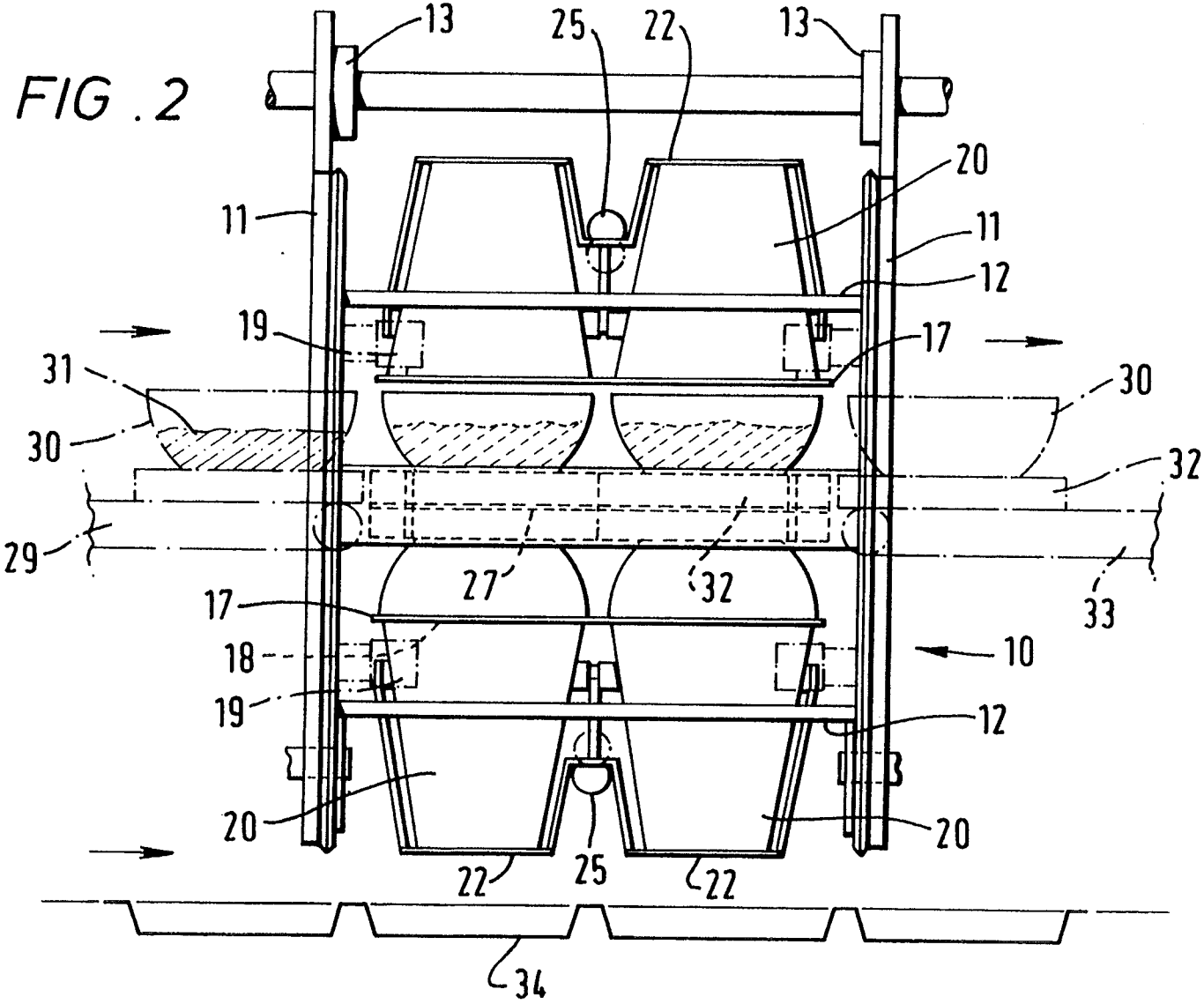
FIG. 2 represents a side section through the filling system.

As illustrated in FIG. 2, a conveyor belt 29 is provided for transporting upright open-topped bowls 30 containing a product 31, each bowl having a foot 32, into the frame, and a conveyor belt 33 is provided for accepting empty upright bowls from guide rails for removing bowls from the frame. Pockets 34 in a MULTIVAC machine pass beneath the frame 10.

In the operation of the apparatus shown in FIGS. 1 and 2, two pairs of upright open-topped bowls 30 containing a given quantity of product 31 are introduced on the conveyor belt 29 into the hollow interior of frame 10 in an upright open-top position suitable for containing the product. The bowls move to the right in the direction of the arrows, as shown in FIG. 2, on the guide rails 27 which slidably contain and guide the bowls through the frame interior side to side. The leading bowl is pushed along the guide rails by the succeeding bowl.

When all four bowls 30 are inside the frame, the mini-cylinder 19 activates the holding plate 17, and hence, the hoppers 20, first to descend to fix the bowls in position on the guide rails 27, and to cover them, and with the slidable covers 22 close the apertures 21 so that product may be contained by the hoppers, which is activated by the mini-cylinders 25. The frame then rotates 180° until the bowls 30 are in the inverted position, and the product 31 flows out of the inverted bowls through the apertures 18 in the holding plate 17 and through the hoppers 20. Upon 180° rotation, the frame rotation stops and the slidable covers 22 are moved by means of sliding plate arms 23 to one side exposing the apertures 21 and the product contained flows from the apertures 21 into the pockets 34, after which, the slidable covers 22 move back to close the apertures 21. The frame then rotates a further 180° until the empty bowls 30 are in the upright position. The holding plates 17, together with the hoppers 20, then ascend to release the empty bowls 30 from the guide rails 27. Two new pairs of filled upright open-topped bowls 30 containing further product 31 are then introduced on the conveyor belt 29 into the upper part of the frame 10 and move to the right in the direction of the arrows, as shown in FIG. 2, and push the empty bowls 30 out of the frame onto the conveyor belt 33 to remove the empty bowls from the side of the frame, after which, the next cycle starts.

In the embodiment shown in FIGS. 1 and 2, when the frame has rotated 180° so that the filled bowls 30 are in an inverted position, two new pairs of upright bowls 30 containing product 31 are introduced into the upper part of the frame 10 on the conveyor belt 29 guided by a second set of guide rails 27.

Figure 3:
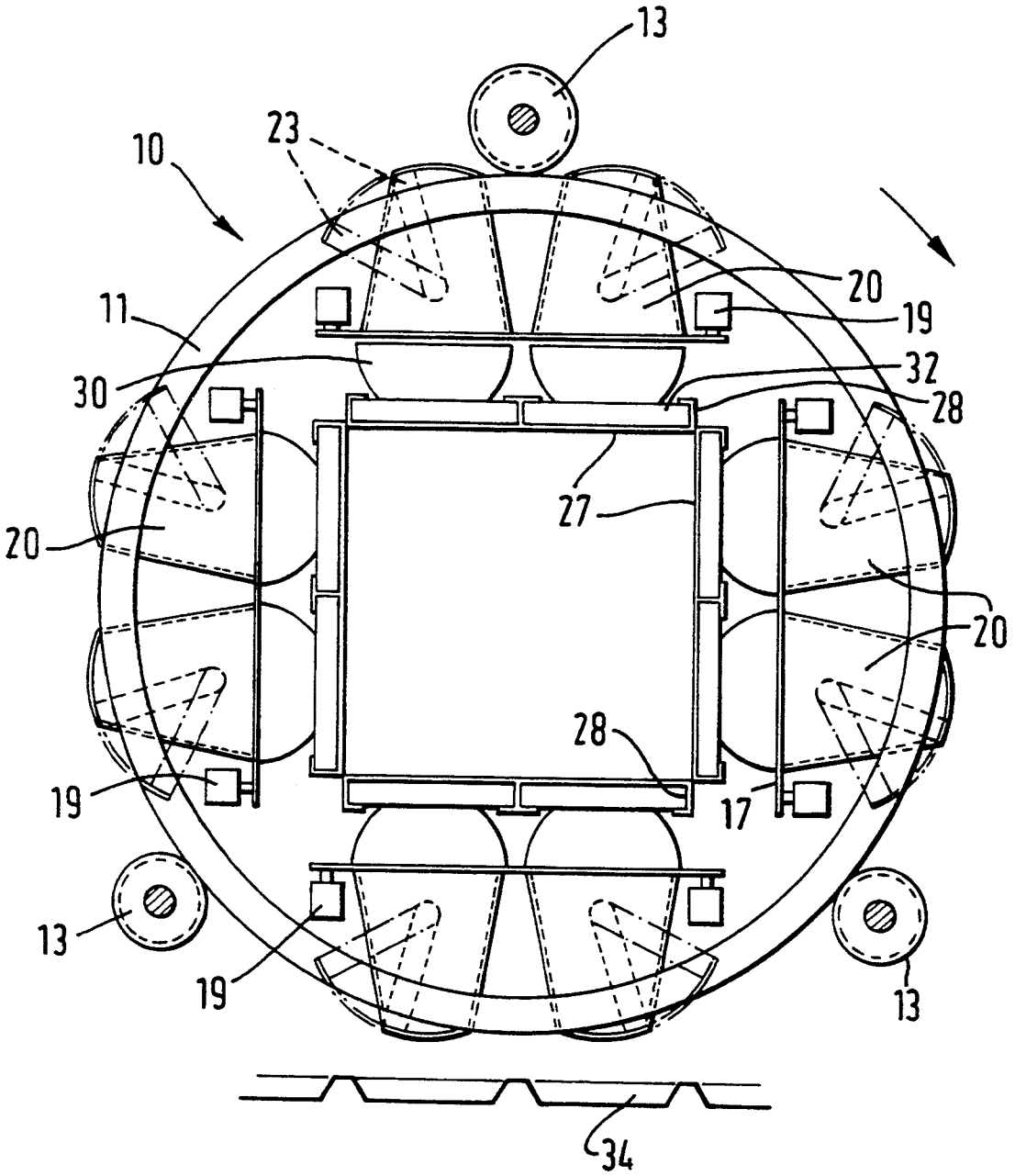
FIG. 3 represents a transverse section through the filling system wherein the frame is capable of carrying more bowls than that of FIG. 1.

In the embodiment shown in FIG. 3, when the frame has rotated 90°, 180°, 270° and 360°, two new pairs of upright bowls 30 containing product are introduced into the upper part of the frame 10 on the conveyor belt 29 guided by second, third and fourth sets of guide rails 27, respectively. In the embodiment shown in FIG. 3, it is possible for the empty bowls to return through the square opening in the center of the frame to the filling station.

Figure 4:
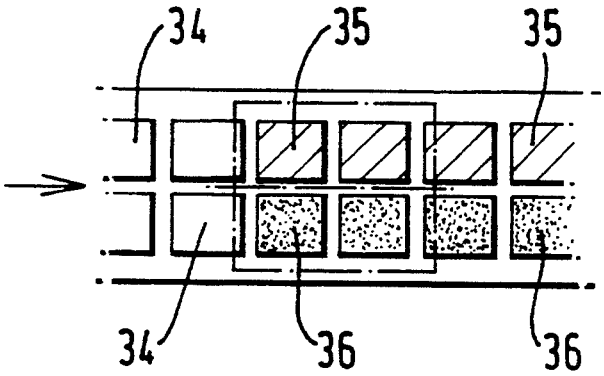
FIG. 4 represents a top plan view of the conveyor of a packaging machine running parallel to the longitudinal axis of the frame.
Figure 5:
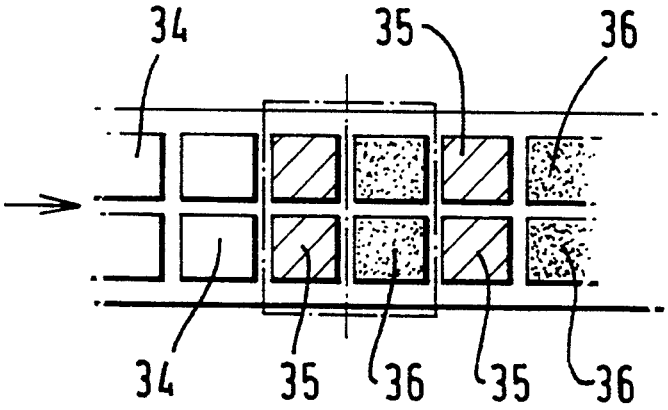
FIG. 5 represents a top plan view of the conveyor of a packaging machine running transversely to the longitudinal axis of the frame.

In FIGS. 4 and 5, one pair of bowls carries a product 35, and the adjacent pair of bowls carries a different product 36, and depending on the direction of travel of the two rows of pockets of the packaging machine beneath the frame, the products may be arranged in single file or in alternate pairs.

The filling system may be operated automatically with the aid of a computer. The frame may rotate at any practical speed, e.g., 20 to 30 cycles per minute.

I claim:

1. An apparatus for transferring products comprising:

a frame comprising first and second spaced-apart side members, each side member being configured to encompass an opening about a central axis, and comprising a plurality of longitudinally extending connecting members which are spaced apart one from another and extend between and connect the side members so that the first and second side members form first and second frame sides which have an opening disposed about the central axis of each side member and so that the connecting members are disposed between the side members so that the frame has an interior hollowed about a frame central axis coincident with the central axis of each side member and so that the frame has openings between the connecting members;

means for rotating the frame so that the frame is rotated about the frame central axis disposed horizontally;

a guide member which extends longitudinally within the interior hollow of the frame from side to side parallel to the frame central axis and is connected to the frame, for slidably containing and guiding an open-topped bowl through the frame interior side to side;

means for feeding an open-topped bowl to the first frame side and to the guide member so that the bowl is fed to the guide member in an upright open-top position suitable for containing a product therein;

means for covering and for uncovering an open top of an open-topped bowl contained in the guide member first to fix and then subsequently to release the bowl in and from the guide member and for, upon rotation of the frame, wherein a bowl containing a product therein rotates with the guide member from an upright to an inverted position, containing a product during the rotation and for releasing the contained product when the bowl is in an inverted position; and means for removing a bowl from a side of the frame.

2. An apparatus according to claim 1 wherein the side members are rings.

3. An apparatus according to claim 1 wherein the guide member is configured for containing a plurality of bowls within the frame interior and wherein the means for covering and uncovering fixes and releases the plurality of bowls to and from the guide member.

4. An apparatus according to claim 1 wherein there are a plurality of guide members positioned for containing a plurality of bowls within the frame interior and wherein the means for covering and uncovering fixes and releases the plurality of bowls to and from the plurality of guide members.

5. An apparatus according to claim 4 wherein the guide members are positioned adjacent one to another and wherein adjacent guides are positioned to form an angle therebetween.

6. An apparatus according to claim 4 wherein there are four guide members positioned adjacent one to another and wherein adjacent guides are positioned to form an angle of 90° therebetween.

7. An apparatus according to claim 1 wherein the means for covering and uncovering and for containing a product during rotation are a hopper extending longitudinally between opposing first and second open hopper ends, a hopper holding plate connected to the hopper and positioned to extend longitudinally parallel to the longitudinal extent of the guide member to position the hopper so that the hopper first open end faces the guide member, and means connected to the plate and fixed to the frame for moving the holding plate and hopper towards and away from the guide member to cover and uncover an open top of a bowl and to fix and release a bowl to and from the guide member, and means connected to the frame for covering and uncovering the hopper second open end for containing and releasing a product.

8. An article transfer apparatus comprising:

a frame comprising first and second spaced-apart rings, each ring being configured to encompass an opening about a central ring axis, and comprising a plurality of longitudinally extending connecting bars which are spaced apart one from another and extend between and connect the two rings so that the first and second rings form first and second frame sides which have an opening disposed about the central axis of each ring and so that the connecting bars are disposed between the side members so that the frame has an interior hollowed about a frame central axis coincident with the central axis of each ring and so that the frame has openings between the connecting bars;

means for rotating the frame so that the frame is rotated about the frame central axis disposed horizontally;

a guide rail member having a base and spaced-apart guide sides which extends longitudinally within the interior hollow of the frame from side to side parallel to the central axis and is connected to the frame and positioned for slidably containing and guiding an open-topped bowl through the frame interior side to side;

a hopper extending longitudinally between opposing first and second open hopper ends, a hopper holding plate connected to the hopper and positioned to extend parallel to the guide rail member to position the hopper so that the first hopper open end faces the guide rail, and means connected to the plate and fixed to the frame for moving the holding plate and hopper towards and away from the guide rail member to cover and uncover an open top of a bowl and first to fix and then subsequently to release a bowl in and from the guide rail;

a cover connected to the frame which is movable for covering and uncovering the hopper second open end so that upon rotation of the frame, wherein a bowl containing a product therein is rotated from an upright to an inverted position, the cover covers the hopper second open end to contain product therein and wherein the cover uncovers the hopper second open end to release the contained product when the bowl is at an inverted position;

means for moving the cover for slidably covering and uncovering the second open end of the hoppers.

9. An apparatus according to claim 8 wherein the guide rail member is configured for containing a plurality of bowls within the frame interior and wherein there are a plurality of hoppers and covers.

10. An apparatus according to claim 8 wherein there are a plurality of guide rail members positioned for containing a plurality of bowls within the frame interior and wherein there are a plurality of hoppers, of hopper holding plates, of means for moving the holding plates and hoppers, of covers and of means for moving the covers.

11. An apparatus according to claim 10 wherein the guide rail members are positioned adjacent one to another and wherein adjacent guide rail members are positioned to form an angle therebetween.

12. An apparatus according to claim 10 wherein there are four guide rail members positioned adjacent one to another and wherein adjacent guides form an angle of 90° therebetween.

13. A process for transferring articles comprising:

introducing an upright open-topped bowl containing a product onto a guide member;

covering the open top of the bowl introduced with means to fix the bowl to the guide member and with means to contain product contained in the bowl when a bowl containing product is moved from an upright product-containing position to an inverted position and to release product from the bowl when inverted;

fixing the bowl to the guide member, closing a cover of the means to contain the product and rotating a frame connected to the guide member to rotate the guide member about an axis so that the fixed bowl is moved from an upright position to an inverted position;

opening the cover of the means to contain the product to release product from the containing means;

rotating the frame to rotate the guide member about the axis from the inverted position to an upright position; and releasing and removing the empty bowl from the guide.

14. A process according to claim 13 wherein the frame is rotated intermittently.

15. A process according to claim 13 wherein the frame is rotated in intervals of 180°.

16. A process according to claim 13 wherein the frame is rotated in intervals of 90°.

* * * * *

UNITED STATES PATENT AND TRADEMARK OFFICE

CERTIFICATE OF CORRECTION

PATENT NO. : 5,341,858

DATED : August 30, 1994

INVENTOR(S) : Lars G. A. Wadell

It is certified that error appears in the above-indentified patent and that said Letters Patent is hereby corrected as shown below:

Title page, under item [19] "Albert" should be --Wadell--.

Title page, in item [73] Assignee" "Sweden" should be --Switzerland--.

Column 6, line 27 (claim 8) after the semicolon, insert --and--.

Signed and Sealed this

First Day of November, 1994

Bruce Lehman

*Attest:*

BRUCE LEHMAN

*Attesting Officer*

*Commissioner of Patents and Trademarks*